United States Patent [19]

Boston

[11] Patent Number: 4,830,730

[45] Date of Patent: May 16, 1989

[54] UNCLOUDED METALS PASSIVATION ADDITIVE

[75] Inventor: Ernest B. Boston, Borger, Tex.

[73] Assignee: Phillips Petroleum Company, Bartlesville, Okla.

[21] Appl. No.: 151,356

[22] Filed: Feb. 2, 1988

[51] Int. Cl.[4] ..... C10G 11/00

[52] U.S. Cl. ..... 208/113; 208/52 CT; 502/521

[58] Field of Search ..... 208/113, 120, 52 CT; 502/521, 64, 60, 62

[56] References Cited

U.S. PATENT DOCUMENTS

| | | | |
|---|---|---|---|
| 3,347,821 | 10/1967 | Malz et al. | 260/45.75 |
| 4,025,458 | 5/1977 | McKay | 252/416 |
| 4,190,552 | 2/1980 | Bertus et al. | 252/411 R |
| 4,321,129 | 3/1982 | Bertus et al. | 208/120 |
| 4,336,168 | 6/1982 | Hoch et al. | 524/300 |
| 4,460,511 | 7/1984 | Boston | 260/446 |
| 4,495,064 | 1/1985 | Boston | 208/120 |
| 4,507,398 | 3/1985 | Boston | 502/62 |
| 4,535,066 | 8/1985 | Mark et al. | 502/521 |
| 4,551,231 | 11/1985 | Kovach et al. | 208/52 CT |
| 4,595,772 | 6/1986 | Blaschke et al. | 556/77 |

*Primary Examiner*—Anthony McFarlane
*Attorney, Agent, or Firm*—K. K. Brandes

[57] ABSTRACT

Unclouded solutions of antimony hydrocarbylthiolate suitable for metals passivation are produced utilizing an amine. In one embodiment of the invention the amine is included with the antimony oxide and hydroxyhydrocarbylthio reactants to produce the passivating agent. In another embodiment of the invention, the metals passivation additive is produced by combining antimony oxide with a hydroxhydrocarbylthiol to produce a reaction mixture which is thereafter contacted with an amine. The resulting product is useful for the passivation of metals deposited on cracking catalysts.

28 Claims, No Drawings

UNCLOUDED METALS PASSIVATION ADDITIVE

BACKGROUND OF THE INVENTION

This invention relates to an unclouded additive useful in the passivation of metals in a catalytic cracking operation. It also relates to the preparation of an additive useful in the passivation of metals in a catalytic cracking operation. It further relates to the cracking of hydrocarbons, particularly the treatment of cracking catalyst with an additive to passivate metals. It still further relates to the preparation of a catalyst composition useful in the presence of metals in a catalytic cracking operation.

Hydrocarbon feedstock containing higher molecular weight hydrocarbons is cracked by contacting it at an elevated temperature with a cracking catalyst whereby distillates such as gasoline and higher boiling hydrocarbon fuels, for example kerosene, diesel fuel, burning oils, fuel oils and the like are produced. Cracking catalyst, when used to crack feedstocks that contain metals, accumulates a deposit of these metals. These metals usually consist of vanadium, iron, and nickel, and this accumulation decreases the yield of gasoline from the cracking operation and increases the yield of hydrogen and coke. Therefore, there is a need for a cracking process or a modified cracking catalyst which will prevent or reduce the deleterious effects of these metal contaminants.

Prior inventions have used antimony compounds to aid in the passivation of metals in these hydrocarbon feed streams. U.S. Pat. No. 4,321,129, incorporated by reference, shows the use of antimony and tin compounds. U.S. Pat. Nos. 4,025,458 and 4,190,552, also incorporated by reference, show antimony compounds alone, are useful for the passivation of metals. With the increased metal content of crude oils today, it is important that the passivation compounds be as inexpensive as possible in order to produce large volumes of gasoline and other higher boiling hydrocarbon fuels in a cost effective manner.

Prior inventions have recognized antimony hydroxyhydrocarbylthiolates as one type of relatively inexpensive antimony compound useful in the passivation of metals, for example see U.S. Pat. Nos. 4,495,064 and 4,507,398. A problem with some antimony hydroxyhydrocarbylthiolates is that they have a cloudy or dark black opaque appearance. While this cloudy appearance does not affect the effectiveness of antimony hydroxyhydrocarbylthiolates as metals passivation additives, the cloudy appearance is objectionable to potential purchasers and can cause operational problems in plants designed to handle clear antimony hydroxyhydrocarbylthiolates, such as where instrumental or visual observations necessary to operate the plant depend on the transmission of light through the antimony hydroxyhydrocarbylthiolate solution.

SUMMARY OF THE INVENTION

It is, therefore, an object of this invention to provide an unclouded passivation additive for metals deposited on cracking catalyst. Another object of this invention is to provide for the preparation of an unclouded passivation additive. A further object of this invention is to provide for the cracking of hydrocarbons, in particular by the treatment of cracking catalyst with an unclouded additive to passivate metals. A still further object of this invention is to provide for the preparation of a catalyst composition useful in the presence of metals in a catalytic cracking operation.

In accordance with the instant invention, amines have been found to be useful for preparing unclouded solutions of antimony hydroxyhydrocarbylthiolate.

DESCRIPTION OF THE PREFERRED EMBODIMENTS

The amines useful in accordance with this invention for preparing an unclouded passivation additive may be selected from one or more amines of the general formula below:

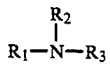

where the $R_1$, $R_2$ and $R_3$ groups which can be the same or different are selected from hydrogen and hydrocarbyls which can be an alcohol, alkyl, alkenyl, clcloalkyl, cycloalkenyl or aryl radical or a combination radical such as alkaryl, aralkyl or alkenylary. Examples of such amines are ammonia, methylamine, ethylamine, propylamine, isopropylamine, butylamine, isobutylamine, sec-butyalmine, tert-butylamine, cyclohexylamine, benzylamine, aniline, methanolamine, ethanolamine, propanolamine, isopropanolamine, butanolamine, isobutanolamine, cyclohexanolamine, dimethylamine, diethylamine, dipropylamine, N-methylaniline, diphenylamine, dimethanolamine, diethanolamine, dipropanolamine, methylethanolamine, ethylmethanolamine, ethylpropanolamine, propylethanolamine, trimethylamine, triethylamine, tripropylamine, trimethanolamine, triethanolamine, tripropanolamine, methyldiethanolamine, dimethylethanolamine and methylethylpropanolamine. Among the amines being more preferred are ethanolamines, diethanolamine and triethanolamine with ethanolamine being most preferred.

The antimony hydroxyhydrocarbylthiolate can be any antimony hydroxyhydrocarbylthiolate and more preferably can be either one or a mixture of different antimony compounds of the general formula below:

$$Sb[SR(OH)n]_3$$

where the R groups which can be the same or different are hydrocarbyl radicals containing not more than 18 carbon atoms and can be alkyl, alkenyl, cycloalkyl, cycloalkenyl or aryl radicals or a combination radical such as alkaryl, aralkyl or alkenylaryl, and n can be 1, 2 or 3 with the hydroxyl groups attached to any of the carbon atoms. Examples of such compounds are antimony tris(2-hydroxyethylthiolate), antimony tris(2-hydroxypropylthiolate), antimony tris(2,3-dihydroxypropyl-1-thiolate), and antimony tris(2-hydroxybenzenthiolate).

The unclouded metals passivation additive may be prepared by reacting antimony oxide with a hydroxyhydrocarbylthiol to form a mixture containing an antimony hydroxyhydrocarbylthiolate and thereafter adding an amine either to the entire solution or any portion thereof. The unclouded additive may also be prepared by reacting antimony oxide with the hydroxyhydrocarbylthiol in the presence of an amine. In both instances the reaction can take place at temperatures which can range from about 20° C. to about 200° C., more preferably from about 30° C. to about 150° C. and most preferably from about 80° C. to a about 130° C. It is presently preferred that the reaction be completed in the substantial absence of both light and oxygen gas. Light can be substantially eliminated by conducting the reaction in an opaque reaction vessel while oxygen gas can be substantially eliminated by maintaining the reaction mixture under an atmosphere of inert gas. Examples of inert gases useful for maintaining an oxygen gas free atmosphere are nitrogen, helium, neon, argon, krypton, xenon and radon with nitrogen, helium and argon being more preferred and nitrogen most preferred.

The hydroxyhydrocarbylthiols useful in this invention can be selected from one or more of the compounds of the general formula:

$$HSR(OH)_n$$

where each R is a hydrocarbyl containing from 1 to about 18 carbon atoms and can be an alkyl, alkenyl, cylcloalkyl, cycloalkenyl or aryl radical or a combination of radicals such as alkaryl, aralkyl and alkenylaryl, and n can be 1, 2 or 3 with the hydroxyl groups attached to any of the carbon atoms. Examples of such compounds are hydroxymethylthiol, dihydroxymethylthiol, 2-hydroxyethylthiol, 1,2-dihydroxyethylthiol, 2,2-dihydroxyethylthiol, 1,2,2-trihydroxyethylthiol, 2-hydroxypropylthiol, 3-hydroxypropyl-1-thiol and 2,3-dihydroxypropyl-1-thiol.

This reaction can be carried out at an absolute pressure which can range from about 0.01 atmosphere to about 20 atmospheres, more preferably from about 0.1 atmosphere to about 2 atmospheres and most preferably from about 0.5 atmosphere to aboug 1.5 atmosphere.

The amount of antimony present in antimony hydroxyhydrocarbylthiolate in the resulting metals passivation additive can range from about 0.1 wt. % to about 39 wt. % based on the total weight of the additive. More preferably, the amount of antimony present in the antimony hydroxyhydrocarbylthiolate additive will range from about 10 wt. % to about 34 wt. % with the range of about 20 wt. % to about 30 wt. % being most preferred, based on the total weight of the additive.

The amount of amine necessary to provide an unclouded metals passivation additive can vary from batch to batch but is usually within the range of from about 1:3000 to about 1:5 expressed as the ratio of the weight of amino nitrogen, which is the nitrogen bonded to $R_1$, $R_2$ and $R_3$ in the formula above, to the weight of antimony in the antimony hydroxyhydrocarbylthiolate. More preferably the amount of amine necessary to provide an unclouded metals passivation additive can vary from about 1:1100 to about 1:30 and most preferably from about 1:300 to about 1:250 expressed as the weight ratio of amino nitrogen to antimony in the antimony hydroxyhydrocarbylthiolate.

The resulting clear liquid antimony hydroxyhydrocarbylthiolate complex can then be used as a metals passivation additive in the instant invention. While not necessary, it is sometimes preferred to filter the clear liquid antimony hydroxyhydrocarbylthiolate complex to remove any solid particulates including unreacted antimony oxide which may be remaining in the antimony hydroxyhydrocarbylthiolate complex.

The amount of antimony compound employed in accordance with this invention can be varied in reasonable ranges. The range for the amount of antimony compound employed is relative to the amount of cracking catalyst to be treated. Any amount sufficient to passivate contaminating metals can be employed. It is presently preferred to use the antimony compound at an amount of less than about 8 weight percent antimony, based on the weight of the cracking catalyst and generally in the range of from about 0.02 to about 2 weight percent antimony, based on the weight of the cracking catalyst.

The cracking catalyst can be contacted with the antimony compound in various ways. One way is to impregnate the cracking catalyst with a solution of the antimony compound in a solvent such as 2-hydroxyethylthiol. In another embodiment the antimony compound either neat or in a solvent is metered to the feed oil of the catalytic cracker upstream of the feed pump. This procedure effects thorough dilution and mixing of the feed oil with the antimony compound and avoids lay downs of this antimony compound on, for example, the heat exchanger walls.

The antimony compound if added to the hydrocarbon feed stock is added at a rate to maintain the concentration of antimony in or on the catalyst generally within the range of 0.0001 to about 8 weight percent, and preferably in the range of about 0.02 to about 2 weight percent based on the weight of cracking catalyst. The amount of antimony compounds actually employed depends upon the concentration of antimony desired to be deposited on the cracking catalyst and the rate of catalyst withdrawal and addition. Once the desired level of the antimony compound on the cracking catalyst has been reached, only a small amount of the antimony compound is necessary in the feedstocks to maintain the desireed level of this compound on the catalyst at equilibrium conditions.

The feedstocks used for cracking processes are conventional hydrocarbon feed stocks, namely petroleum, fuel oil, shale oil, gas oil and topped crudes. The cracking step of the catalytic cracking process is carried out at elevated temperatures of about 400° to about 650° C. and pressures in the range from atmospheric pressure up to 200 atmospheres.

The catalyst used for the cracking step is a conventional cracking catalyst. These catalysts generally contain silica or silica-alumina. Such materials are frequently associated with zeolitic materials. These zeolitic materials can be naturally occurring, or they can be produced by conventional ion exchange methods such as to provide metallic ions which improve the activity of the catalyst. Zeolite-modified silica-alumina catalysts are particularly applicable in this invention.

Examples of cracking catalysts into or onto which antimony can be incorporated include hydrocarbon cracking catalysts obtained by admixing an inorganic oxide gel with an aluminosilicate and aluminosilicate compositions which are strongly acidic as a result of treatment with a fluid medium containing at least one rare earth metal cation and a hydrogen ion, or ion capable of conversion to a hydrogen ion. The unused catalytic cracking material employed will generally be in particulate form having a particle size principally within the range of about 10 to about 200 microns.

In order to facilitate the handling of viscous liquid antimony hydroxyhydrocarbylthiolates, solvents can be employed to dilute these compounds. For example, excess hydroxyhydrocarbylthiols, used in the preparation of the antimony hydroxyhydrocarbylthiolates or even crude by-products such as dimers, for example, thiodiglycol, or higher homologs resulting from the manufacture of hydroxyhydrocarbylthiol can be used as diluents.

These antimony compounds resist dilution by other solvents unless the antimony compounds are already diluted with hydroxyhydrocarbylthiol. When at least 20 weight percent thiol is present, then polar solvents such as ethylene glycol, dimethylformamide, dimethylacetamide, tetrahydrofuran, and ethylene glycol monobutyl ether, 2-propanol, and water can be used.

Other uses for these antimony compounds include their use as hydraulic fluid additives or as a fire retardants for plastics.

The invention will be more fully understood from the following examples.

EXAMPLE I

This Example discloses the prparation of antimony tris(2-hydroxyethylthiolate). This compound was prepared by the stoichiometric reaction between antimony oxide, $Sb_2O_3$, and 2-mercaptoethanol, also called 2-hydroxyethylthiol, $HSCH_2CH_2OH$.

A 1 L stirred round-bottom flask was charged with 291.5g (1.00 mole) $Sb_2O_3$ and 470g (6.00 mole) $HSCH_2CH_2OH$, under a stream of nitrogen gas. An exotermic reaction occurred as the temperature of the mixture rose to 80° C. A mantle heater was used to raise and maintain the temperature at about 110° C. for about 2 hours. The reaction mixture became a viscous yellow liquid with a small amount of suspended white solid. During the reaction, 37 mL water by-product was collected in a Dean-Stark condenser trap. The reaction mixture was filtered to remove solids.

An infrared spectrum of the liquid product showed the absence of a SH stretching band around 2500 $cm^{-1}$ and the presence of a strong OH stretching band at 3450 $cm^{-1}$, consistent with antimony tris(2-hydroxyethylthiolate) structure.

In a second preparative run under the same conditions except that an excess of 2-mercaptoethanol was used to serve as a diluent, 55 mL water by-product (3 moles) was recovered. That amount of water is consistent with complete reaction of the antimony.

A third preparation of antimony tri(2-hydroxyethylthiolate) was made in an evacuated (20 mm) filter flash on a magnetic stirring hot plate. To 71.04g (0.243 moles) $Sb_2O_3$ were added 174.4g (2.23 moles) 2-mercaptoethanol. The temperature of the mixture was maintained between 80° and 130° C. for two hours. A small amount of solid was filtered off to produce a clear yellow liquid product. Ethylene glycol, 2-butyoxyethanol and water were found to be suitable diluents for the viscous yellow product.

EXAMPLE II

A commercial cracking catalyst that had been used in a commercial fluid catalytic cracker until it had attained equilibrium composition with respect to metals accumulation (catalyst was being removed from the process system at a constant rate) was used to demonstrate passivation with antimony tri(2-hydroxyethylthiolate). The catalyst, being a synthetic zeolite combined with amorphous silica/alumina (clay), was predominately silica and alumina. Concentrations of other elements together with a pertinent physical properties are shown in Table I.

TABLE I

| | |
|---|---|
| Surface area $m^2g^{-1}$ | 75.9 |
| Pore Vol., $mLg^{-1}$ | 0.36 |
| Composition, wt. % | |
| Nickel | 0.38 |
| Vanadium | 0.58 |
| Iron | 0.85 |
| Alumina | 23.4 |
| Silica | 22.8 |
| Sodium | 0.46 |
| Cesium | 0.39 |

Catalyst A was prepared by diluting antimony tris(2-hydroxyethylthiolate) and excess 2-hydroxyethylthiol with 2-propanol and adding it to 40 g of equilibrium cracking catalyst. Solvent was removed by heating, with stirring, on a hot plate at about 260° C. This treatment added 0.5 wt. % antimony to the catalyst.

Catalyst B was prepared by adding antimony tris(0,0-di-n-propylphosphorodithioate) to 40 g of equilibrium cracking catalyst. Dry cyclohexane was added to dissolve the antimony compound and facilitate its distribution over the catalyst. After stirring, the mixture was heated to about 260° C. until the solvent was evaporated. This catalyst contained 0.5 wt. % antimony.

Each catalyst was then prepared for testing by aging it. The catalyst in a quartz reactor was fluidized with nitrogen while being heated to 482° C., then it was fluidized with hydrogen while the temperature was raised from 482° to 649° C. Maintaining that temperature, fluidization continued for 5 minutes with nitrogen, and for 15 minutes with air. The catalyst was then cooled to about 482° C.; still being fluidized with air. The catalyst was then aged through 10 cycles, each cycle being conducted in the following manner. The catalyst at about 482° C. was fluidized with nitrogen for 1 minute, and heated to 510° C. during 2 minutes while fluidized with hydrogen, then maintained at 510° C. for 1 minute while fluidized with nitrogen then heated to about 649° C. for 10 minutes while fluidized with air, and then cooled to about 482° C. during 0.5 minutes while fluidized with air. After 10 cycles it was cooled to room temperature while being fluidized with nitrogen.

The equilibrium catalyst and catalysts A and B were evaluated in a fluidized bed reactor using heavy oil as feedstock to the cracking step. A cracking reaction was carried out at 510° C. at atmospheric pressure for 0.5 minutes and the regeneration step was conducted at about 649° C. and atmospheric pressure for about 30 minutes using fluidizing air, the reactor being purged with nitrogen before and after each cracking step.

Properties of a heavy crude used in the cracking steps are summarized in Table II.

TABLE II

| | |
|---|---|
| API Gravity at 15.6° C. | 18.2 |
| Distillation (ASTM D 1160-61) | |
| 5% | 729° F. |
| 50% | 991° F. |
| Conradson Carbon | 5.71 wt. % |
| Analysis for some elements | |
| Hydrogen | 12.1 wt. % |
| Carbon | 85.9% |
| Oxygen | 0.8 wt. % |
| Sulfur | 0.45 wt. % |
| Nitrogen | 0.15% |
| Nickel | 8.05 ppm |
| Vanadium | 15.7 ppm |
| Copper | 2.8 ppm |
| Iron | 4.3 ppm |
| Sodium | 10.9 ppm |

Results of the tests using the equilibrium catalyst and catalysts A and B are summarized in Table III.

TABLE III

| Catalyst | Equilibrium | A | B |
|---|---|---|---|
| Catalyst:Oil Wt. Ratio | 7.1 | 7.1 | 7.1 |
| Conversion Vol. % of Feed | 77.9 | 78.1 | 76.0 |
| Gasoline Yield Vol. % of Feed | 56.0 | 58.6 | 58.4 |
| Hydrogen Yield SCF/bbl Feed | 792 | 476 | 456 |
| Converted Coke Yield Wt. % of Feed | 15.6 | 13.3 | 12.9 |

Comparison of the results from the average of two runs with catalyst A with those from untreated equilibrium catalyst show that the use of antimony tris(2-hydroxyethylthiolate) as a metals passivation additive significantly improved the performance of metals contaminated equilibrium catalyst. Lower yields of coke and hydrogen along with the increased gasoline yield are shown. The results indicate that catalyst A is just as effective as catalyst B. Catalyst B is a commercially made passivation catalyst. This work indicates that antimony tris(2-hydroxyethylthiolate) as a metals passivation agent is as effective as the more expensive, commercially available antimony tris(0,0-D-n-propylphosphorodithioate).

EXAMPLE III

This Example shows the formation of opaque antimony hydroxyhydrocarbylthiolate complex solutions when some supplies of antimony oxide are used.

Reaction III-1:

1.00 weight unit of $Sb_2O_3$ from Supplier 1 was combined with 2.06 weights of 2-hydroxyethylthiol under a nitrogen purge in the absence of light. The reaction mixture was stirred for 2.25 hours then heated and stirred for another 1.75 hours after which the temperature was 88° C. and the reaction was stopped.

Reaction III-2:

1.00 weight unit of $Sb_2O_3$ from Supplier 2 was combined with 2.11 weights of 2-hydroxyethylthiol under a nitrogen purge in the absence of light. The reaction mixture was stirred for 1.25 hours and then heated and stirred until the reaction was stopped.

Reaction III-3:

1.00 weight unit of $Sb_2O_3$ from Supplier 1, but of a different lot than that used for Reaction III-1 was combined with 2.22 weights of 2-hydroxyethylthiol under a nitrogen purge in the absence of light. The reaction mixture was stirred until the reaction was stopped.

Analysis of the products of these three reactions showed that the product of Reaction III-1 was an opaque clouded blackish brown color, the product of Reaction III-2 was an opaque, clouded blackish brown color and the product of Reaction III-3 was a clear yellowish green color. It is therefore believed that some supplies of $Sb_2O_3$ produce antimony hydroxyhydrocarbylthiolate solutions which are cloudy, while other supplies of $Sb_2O_3$ yield a product which is clear.

EXAMPLE IV

This Example shows the use of an amine to produce an unclouded antimony hydroxyhydrocarbylthiolate. In this reaction 1.00 weight of $Sb_2O_3$ was combined with 2.53 weights of 2-hydroxyethylthiol under a nitrogen purge in the absence of light. The reaction mixture was stirred until the reaction was stopped, at which time the solution was observed to be a cloudy opaque brown color. To this cloudy mixture was then added 0.0134 weights of ethanolamine with the result that the solution became a transparent brown color.

That which is claimed is:

1. A process for cracking a hydrocarbon feedstock which comprises contacting said hydrocarbon feedstock with an active hydrocarbon cracking catalyst under cracking conditions wherein said cracking catalyst has been modified with an amount of passivating additive in a solvent in an amount sufficient to passivate contaminating metals and wherein said passivating additive comprises antimony hydroxyhydrocarbylthiolate in an amount such that the weight of antimony ranges from about 0.001 to about 8 weight percent, based on the weight of said cracking catalyst and is selected from at least one compound with the formula $Sb[SR(OH)n]_3$ where R is a hydrocarbyl group having from 1 to about 18 carbon atoms and n is 1, 2 or 3, and wherein said antimony hydroxyhydrocarbylthiolate is formed by reacting an antimony oxide with a hydroxyhydrocarbylthiolate in the presence of an amine selected from at least one of the group consisting of ethanolamine, diethanolamine and triethanolamine.

2. A process in accordance with claim 1 wherein said amine is present in an amount such that the ratio of the weight of amino nitrogen to the weight of antimony in the antimony hydroxyhydrocarbylthiolate is within the range of from about 1:3000 to about 1:5.

3. A process in accordance with claim 1 wherein said amine is present in an amount sufficient so that the ratio of the weight of amino nitrogen to the weight of antimony in the antimony hydroxyhydrocarbyl-thiolate is within the range of from about 1:1100 to about 1:30.

4. A process according to claim 1 wherein said passivating additive is added to said hydrocarbon feedstock.

5. A process according to claim 1 wherein said reacting is carried out at a temperature that is within the range of from about 20° C. to about 200° C.

6. A process according to claim 5 wherein said reacting is carried out in the substantial absence of oxygen gas and light.

7. A process according to claim 1 wherein said antimony oxide is $Sb_2O_3$, and said hydroxyhydrocarbylthiol is 2-hydroxyethylthiol and said amine is ethanolamine.

8. A process for modifying an active hydrocarbon cracking catalyst comprising contacting said catalyst with a passivating additive in a solvent in an amount sufficient to passivate contaminating metals wherein said passivating additive is comprised of an antimony hydroxyhydrocarbylthiolate selected from at least one compound of the formula $Sb[SR(OH)n]_3$ where R is a hydrocarbyl having from 1 to about 18 carbon atoms and n is 1, 2 or 3 wherein said antimony hydroxyhydrocarbylthiolate is present in an amount such that the weight of antimony ranges from about 0.0001 to about 8 weight percent based on the weight of said cracking catalyst, said antimony hydroxyhydrocarbylthiolate having been formed by reacting an antimony oxide with a hydroxyhydrocarbylthiolate in the presence of an amine selected from at least one of the group consisting of ethanolamine, diethanolamine and triethanolamine.

9. A process according to claim 8 wherein said amine is present in an amount such that the ratio of the weight of amino nitrogen to the weight of antimony in the antimony hydroxyhydrocarbylthiolate is within the range of from about 1:1100 to 1:30.

10. A process in accordance with claim 8 wherein said amine is present in an amount sufficient so that the ratio of the weight of amino nitrogen to the weight of antimony in the antimony hydroxyhydrocarbylthiolate is within the range of from about 1:300 to 1:250.

11. A process in accordance with claim 8 wherein said reacting is carried out at a temperature that is within the range of from about 20° C. to about 200° C.

12. A process in accordance with claim 11 wherein said reacting is carried out in the substantial absence of oxygen gas and light.

13. A process in accordance with claim 8 wherein said antimony oxide is $Sb_2O_3$, said hydroxyhydrocarbylthiol is 2-hydroxyethylthiol and said amine is ethanolamine.

14. A process for cracking a hydrocarbon feedstock which comprises contacting said hydrocarbon feedstock with an active hydrocarbon cracking catalyst under cracking conditions wherein said cracking catalyst has been modified with an amount of passivating additive in a solvent sufficient to passivate contaminating metals and wherein said passivating additive comprises antimony hydroxyhydrocarbylthiolate in an amount such that the weight of antimony ranges from about 0.0001 to about 8 weight percent, based on the weight of said cracking catalyst and is selected from at least one compound with the formula $Sb[SR(OH)n]_3$ where R is a hydrocarbyl group having from 1 to about 18 carbon atoms and n is 1, 2 or 3, and wherein said antimony hydroxyhydrocarbylthiolate is contacted with an amine selected from at least one of the group consisting of ethanolamine, diethanolamine and triethanolamine prior to contact with said cracking catalyst.

15. A process in accordance with claim 14 wherein said amine is present in an amount sufficient so that the ratio of the weight of amino nitrogen to the weight of antimony in said antimony hydroxyhydrocarbylthiolate is within the range of from about 1:1100 to about 1:30.

16. A process according to claim 15 wherein said passivating additive is added to said hydrocarbon feedstock.

17. A process in accordance with claim 15 wherein said amine is present in an amount sufficient so that the ratio of the weight of amino nitrogen to the weight of antimony in the antimony hydroxyhydrocarbylthiolate is within the range of from about 1:1100 to about 1:30.

18. A process according to claim 14 wherein said antimony hydroxyhydrocarbylthiolate is contacted with said amine at a temperature that is within the range of from about 20° C. to about 200° C.

19. A process according to claim 18 wherein said antimony hydroxyhydrocarbylthiolate is contacted with said amine in the substantial absence of oxygen gas and light.

20. A process for modifying an active hydrocarbon cracking catalyst comprising contacting said catalyst with a passivating additive in a solvent in an amount sufficient to passivate contaminating metals wherein said passivating additive is comprised of an antimony hydroxyhydrocarbylthiolate, selected from at least one compound with the formula $Sb[SR(OH)n]_3$ where R is a hydrocarbyl group having from 1 to about 18 carbon atoms and n is 1, 2 or 3, wherein said antimony hydroxyhydrocarbylthiolate is present in an amount such that the weight of antimony ranges from about 0.0001 to about 8 weight percent, based on the weight of said cracking catalyst, said antimony hydroxyhydrocarbylthiolate having been contacted with an amine selected from at least one of the group consisting of ethanolamine, diethanolamine and triethanolamine prior to contact with said cracking catalyst.

21. A process according to claim 20 wherein said amine is present in an amount sufficient so that the ratio of the weight of amino nitrogen to the weight of antimony as antimony hydroxyhydrocarbylthiolate is within the range of from about 1:1100 to 1:30.

22. A process in accordance with claim 21 wherein said amine is present in an amount sufficient so that the ratio of the weight of amino nitrogen to the weight of antimony as antimony hydroxyhydrocarbylthiolate is within the range of from about 1:300 to 1:250.

23. A process in accordance with claim 20 wherein said antimony hydroxyhydrocarbylthiolate is contacted with said amine at a temperature that is within the range of from about 20° C. to about 200° C.

24. A process in accordance with claim 23 wherein said antimony hydroxyhydrocarbylthiolate is contacted with said amine in the substantial absence of oxygen gas and light.

25. A process for cracking a hydrocarbon feedstock which comprises contacting said hydrocarbon feedstock with an active hydrocarbon cracking catalyst under cracking conditions wherein said cracking catalyst has been modified with an amount of a passivating additive sufficient to passivate contaminating metals and wherein said passivating additive comprises an antimony hydroxyhydrocarbylthiolate said antimony hydroxyhydrocarbylthiolate having been prepared in the presence of an amine.

26. A process for modifying an active hydrocarbon cracking catalyst comprising contacting said catalyst with a passivating additive in an amount sufficient to passivate contaminating metals wherein said passivating additive is comprised of an antimony hydroxyhydrocarbylthiolate, said antimony hydroxyhydrocarbylthiolate having been prepared in the presence of an amine.

27. A process for cracking a hydrocarbon feedstock which comprises contacting said hydrocarbon feedstock with an active hydrocarbon cracking catalyst under cracking conditions wherein said cracking catalyst has been modified with an amount of a passivating additive sufficient to passivate contaminating metals wherein said passivating additive comprises an antimony hydroxyhydrocarbylthiolate and wherein, prior to being used to modify said cracking catalyst, said antimony hydroxyhydrocarbylthiolate is contacted by an amine.

28. A process for modifying an active hydrocarbon cracking catalyst comprising contacting said catalyst with a passivating additive in an amount sufficient to passivate contaminating metals wherein said passivating additive is comprised of an antimony hydroxyhydrocarbylthiolate, said antimony hydroxyhydrocarbylthiolate and wherein, prior to being used to modify said cracking catalyst, said antimony hydroxyhydrocarbylthiolate is contacted by an amine.

* * * * *

UNITED STATES PATENT AND TRADEMARK OFFICE

CERTIFICATE OF CORRECTION

PATENT NO. : 4,830,730

DATED : May 16, 1989

INVENTOR(S) : Ernest B. Boston

It is certified that error appears in the above-identified patent and that said Letters Patent is hereby corrected as shown below:

Claim 1, Column 8, line 17, delete "0.001" and substitute --- 0.0001 --- therefor.

Claim 3, Column 8, line 33, delete "1" and substitute --- 2 --- therefor.

Claim 4, Column 8, line 38, delete "1" and substitute --- 2 --- therefor.

Signed and Sealed this

Twentieth Day of February, 1990

*Attest:*

JEFFREY M. SAMUELS

*Attesting Officer*

*Acting Commissioner of Patents and Trademarks*